United States Patent [19]

Miels

[11] 4,105,232

[45] Aug. 8, 1978

[54] CORNER-RETAINING LATCH APPARATUS FOR DOORS

[76] Inventor: Howard J. Miels, R.R. #2, Brook Park, Minn. 55007

[21] Appl. No.: 805,425

[22] Filed: Jun. 10, 1977

[51] Int. Cl.[2] ..... E05C 19/18

[52] U.S. Cl. ..... 292/288

[58] Field of Search ..... 292/288, 300, 302, 343, 292/258, DIG. 46; 248/300

[56] References Cited

U.S. PATENT DOCUMENTS

| | | | |
|---|---|---|---|
| 95,231 | 9/1869 | Jones | 292/288 |
| 648,051 | 4/1900 | Payne | 292/288 X |
| 1,129,572 | 2/1915 | Jephson | 292/288 |
| 1,787,734 | 1/1931 | Rowling | 248/300 |
| 3,620,483 | 11/1971 | Weinberger | 292/288 X |

*Primary Examiner*—Richard E. Moore

*Attorney, Agent, or Firm*—Williamson, Bains, Moore & Hansen

[57] ABSTRACT

A latch apparatus for doors and gates usable with swinging or sliding doors has a mounting bracket which is fixed to a door frame adjacent the door with a pair of converging guideways for retention of a keeper having a slidable tongue which may be removably inserted into the guideways. Extending outwardly from the tongue is a rigid L-shaped strap which fits about and retains a corner of a door to restrain swinging or sliding of the door relative to the strap. The tongue lockably cams within the guideways when force is applied against the strap so as to force the door. Additionally, the lateral sides of the tongue are provided with camming edges which engage a roughened surface within the guideways to further lock the tongue within the guideways. Each lateral side of the tongue has a fulcrum which bears against the guideways to permit the tongue to be sharply pivoted about the fulcrum by an operator so as to shatter and dislodge ice and accumulations in the guideways which would otherwise interfere with operation of the latch.

4 Claims, 8 Drawing Figures

CORNER-RETAINING LATCH APPARATUS FOR DOORS

BACKGROUND OF THE INVENTION

This invention relates to the field of latches usable with sliding and swinging doors, gates, and the like and is particularly adapted to retaining the corners of machine shed doors and fence gates.

While the invention disclosed herein is adaptable to a variety of sliding and swinging doors or gates, it is particularly adaptable to the retention and latching of the large sliding doors commonly found on farm machine sheds. Such machine sheds normally have either one or two large sliding doors to permit tractors, implements, and the like to be moved into and out of the machine shed and such doors are normally slidably mounted and suspended from an overhead track. Because of the substantial size of such doors, they are particularly susceptible to dislodgment by wind and, even in moderate winds, have a tendency to swing and flap. If such flapping is not arrested, its frequency and magnitude can increase until the door is dislodged from the overhead track or even blown off the machine shed.

A partial solution to the wind dislodgment problem has been the driving of one or more heavy stakes or pipes into the earth adjacent the door to resist flapping movement. While this step is partially successful, the pipe is often in the way, is hazardous to those walking near the door and generally must be placed so near the door that it also provides interference with door movement when ice and snow accumulate in winter months. For these reasons, an improved apparatus for containment of machine shed doors is needed so as to retain the door closely against the machine shed in both open and closed positions of the door, to be resistant to ice, snow and extremes of weather and to be nonhazardous to those using the doors. The present invention solves these problems.

SUMMARY OF THE INVENTION

The invention utilizes a mounting bracket which is attached to a door frame or fence frame adjacent the door or gate to be restrained by the latch apparatus. The bracket has a pair of spaced-apart, converging guideways into which a tongue member of a keeper is removably inserted. Fixed to and extending outwardly from the tongue is a rigid, L-shaped strap which fits about the corner of the door and closely retains the door between the strap and the mounting bracket.

Because wind forces applied to machine shed doors can sometimes be intense, it is necessary to provide a latch apparatus which is resistant to such forces and which will resist dislodgment of the tongue from the guideways even under high wind conditions. This result is obtained by use of a special guideway and tongue construction. The guideways are provided with spacer plates fixed to the mounting bracket and having a thickness greater than the tongue. A guide plate is rigidly fixed to each spacer and the plates overlie the spacers to define a pair of tracks into which the tongue is inserted. Because the tongue is of less thickness than the spacers, the tongue has a tendency to cam and lock within the tracks when the door is urged outwardly against the strap as would be the result in response to wind applied to the door.

The lateral, track engaging sides of the tongue are provided with camming edges which, during camming, interlock with a roughened spacer support surface along each spacer to thereby further resist extraction of the tongue from the guideways.

Another problem to be overcome by a latch apparatus usable with machine shed doors is that such latches are commonly exposed to ice and snow, and it is desirable that the tongue not be frozen in place in the guideways or be unremovable by an operator. This problem is solved by providing the lateral track engaging sides of the tongue with fulcrums which bear against the spacer support surface when the tongue is inserted in the guidemeans, permitting an operator to sharply jerk the outwardly extending strap and cause sharp pivoting movement of the tongue about the fulcrum to thereby break loose and dislodge any ice or snow accumulation between tongue and guidemeans.

The latch apparatus has a tongue which is generally flat and hexagonal with the lateral track-engaging sides having upper and lower converging and generally equal length sections so that the tongue may be inserted within the guidemeans with either the upper sections or lower sections entering the guideways first. This results in the tongue being reversible to permit the L-shaped strap to extend laterally leftward or rightward from the mounting bracket and to thus retain the door in open or closed position.

While the invention is particularly well-adapted to the containment of machine shed doors, it should be understood that it is equally adaptable to a wide range of sliding or swinging doors and is particularly useful for the containment of sliding or swinging gates of fences where substantial forces can be expected to be applied to the gate by livestock.

The advantages and novel features which characterize the invention are set out with particularity in the claims attached hereto and forming a part of this description. For a full understanding of the invention and the objects and advantages obtained through its use, reference should be made to the drawing which forms a further part hereof and to the accompanying description in which is illustrated and described a preferred embodiment of the invention.

DESCRIPTION OF THE PREFERRED EMBODIMENT

Figure 1:
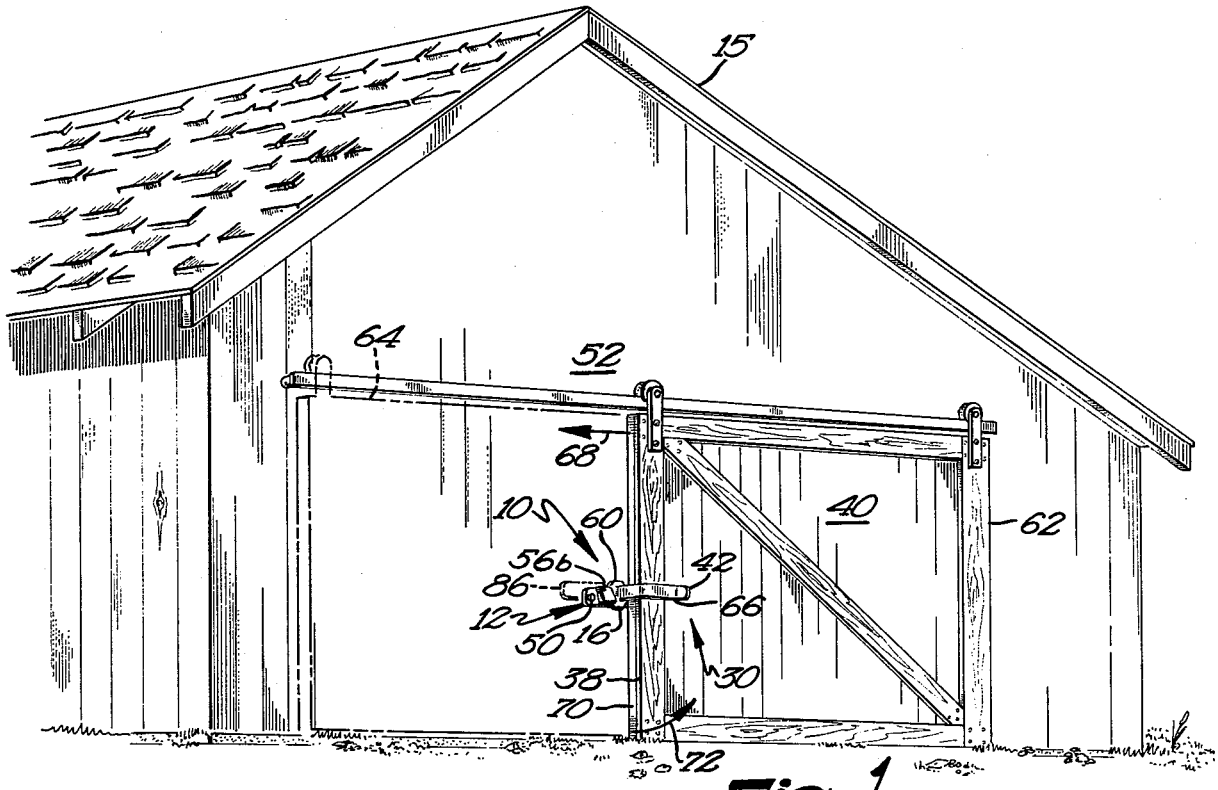
FIG. 1 is a perspective view showing an enlarged embodiment of the latch apparatus in operation and attached to the side of a machine shed and retaining a sliding door of the shed.
Figure 2:
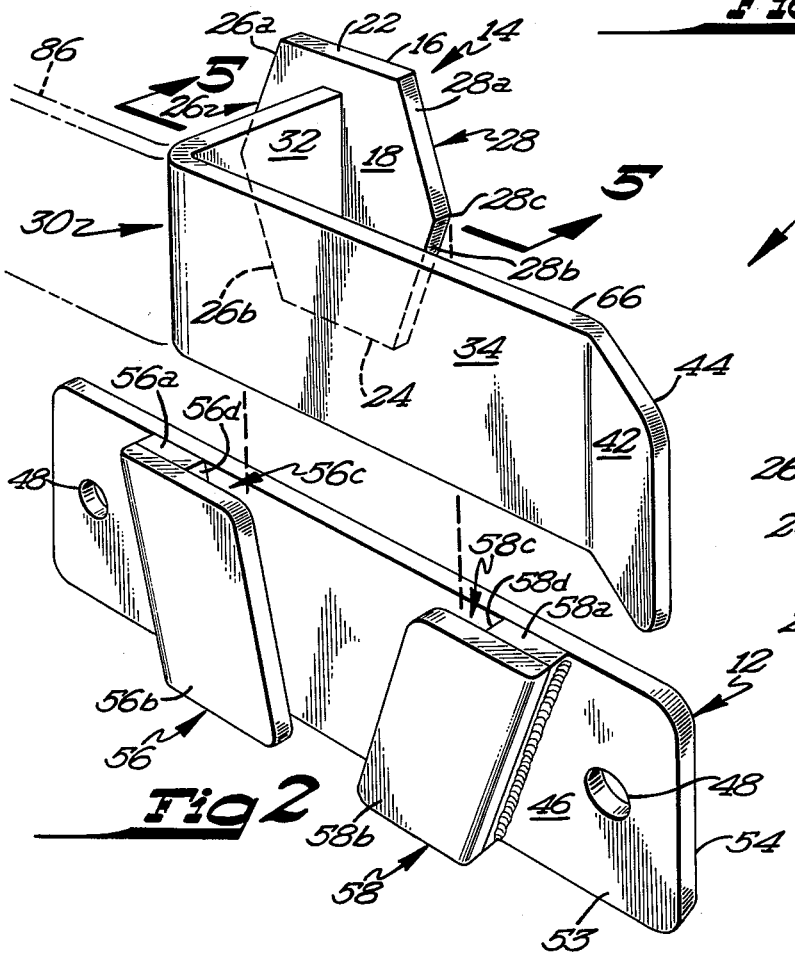
FIG. 2 is an exploded perspective view of the embodiment of the latch apparatus shown in FIG. 1.
Figure 5:
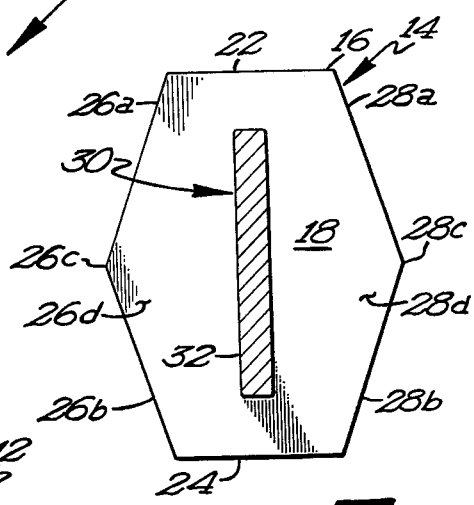
FIG. 5 is a cross sectional, front elevation view of a keeper embodying the invention and taken in the direction of arrows 5—5 of FIG. 2.
Figure 3:
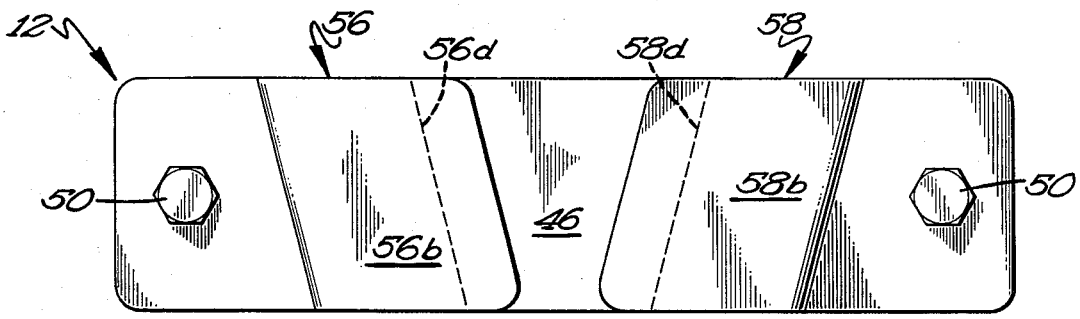
FIG. 3 is a front elevation view of the mounting bracket used with the embodiment of the latch apparatus shown in FIG. 2.
Figure 4:
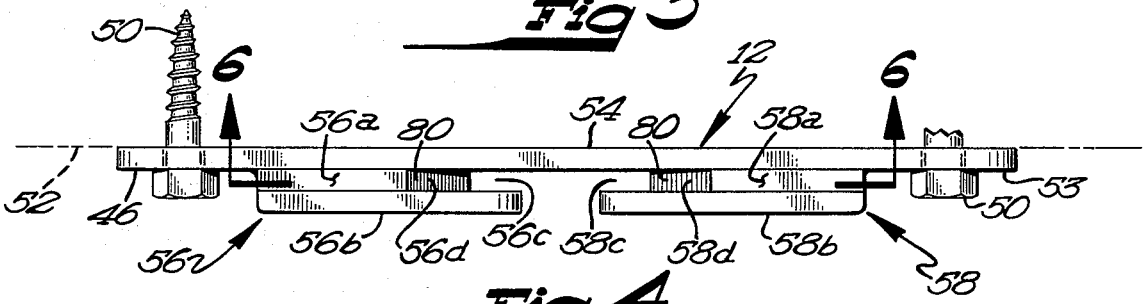
FIG. 4 is a top elevation view of the mounting bracket shown in FIG. 3.

Referring now to FIGS. 1 and 2, the latch apparatus 10 includes a mounting bracket 12 attachable to a door frame or wall 52 of a machine shed 15 and a keeper 14 which is slidably, removably insertable in the bracket 12, as shown in FIG. 1.

The keeper 14 has a tongue 16 made of a rigid material such as steel sheet and preferably being flat and hexagonal in shape. The tongue 16 has an outer face 18 and a substantially parallel reverse face 20.

Generally parallel tongue top 22 and bottom 24 are interconnected by spaced-apart, symmetrical, lateral, track-engaging sides 26 and 28. Lateral side 26 includes upper and lower sections 26*a* and 26*b*, respectively, and lateral side 28 includes substantially identical upper and lower sections 28*a* and 28*b*, respectively.

The intersection of upper and lower sections 26*a* and 26*b* defines a reasonably sharp camming edge 26*c*, which is oriented transversely to the plane of the flat tongue 16 and will be described further hereafter. Similarly, the intersection between upper and lower sections 28*a* and 28*b* defines a camming edge 28*c*.

The tongue 16, which is preferably shaped as a regular hexagon with upper and lower sections 26*a*, 26*b*, 28*a* and 28*b* being of equal length also has the described upper and lower sections protruding laterally outwardly to define two opposed corners of the hexagonal plate, resulting in the formation of fulcrums 26*d* and 28*d* which permit pivoting of the tongue 16 about the camming edges 26*c* and 28*d* against the guidemeans as will be described further hereafter.

Fixed to the tongue 16 in any way known to the art, and extending transversely forwardly, outwardly from the outer face 18 is an integral rigid door-engaging strap 30 which is preferably formed of rigid material such as steel. The strap 30 has a first generally straight segment 32 which preferably extends outwardly from and perpendicular to the outer face 18. Extending transversely from the first segment 32 is a second segment 34 which is preferably oriented perpendicular to segment 32 and extends laterally, horizontally from the first segment of the tongue and is preferably parallel to the outer face 18. The segments 32 and 34 define a door corner retaining means which closely confronts and encompasses a corner 34 of a door 36 to be retained by the latch 10, and the first and second segments cooperate with the mounting bracket 12 to retain the door therebetween.

While the invention is described as being primarily used for retaining of a machine shed door, it should be understood that it may just as readily be used on other doors, gates or other sliding or swinging closures, and the term door, as used throughout this disclosure should be construed to include other closures including, but not limited to, fence gates and doors in general.

Figure 7:
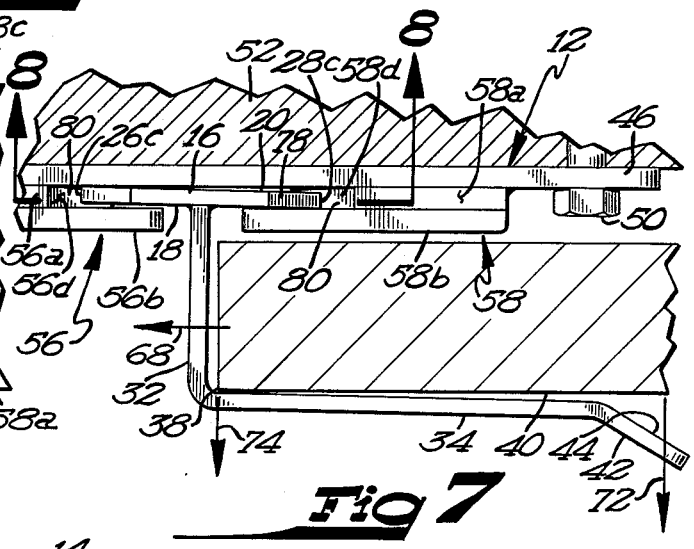
FIG. 7 is a top elevation view of the lock apparatus showing the camming action between keeper and mounting bracket with the keeper in camming position.

Located at the free end of the strap 30 and extending from the second segment 34 is a third segment 42 which is angled forwardly, transversely outwardly from the second segment 34 at an angle of approximately 30 degrees, although this angle may be increased or decreased somewhat while still being effective. The third segment has a door deflecting surface 44 positioned to receive and guide an approaching sliding door 40 as it nears the latch apparatus 10 so as to direct the door within the second segment 34 and against the first segment 32 where it can be retained between the strap 30 and the mounting bracket 12. As best shown in FIG. 1, a sliding door moving toward the latch apparatus 10 in direction 68 will strike door deflecting surface 44 (FIG. 7) and be guided along the second segment 34 of the strap 30.

The mounting bracket 12 has a generally elongated, rectangular, rigid mounting plate 46 preferably formed of sheet steel and suitable for attachment to the door frame or wall 52 adjacent doorway or fence, the mounting plate 46 being provided with transverse screw receiving apertures 48 extending between outer surface 53 and reverse surface 54, through which screws 50 extend into the door frame or wall 52.

The mounting bracket 12 includes first and second spaced-apart, converging guideways 56 and 58, respectively, each of which is rigidly fixed to the outer surface 53 of the mounting plate in any way known to the art, welding being preferred. The guideway 56 includes a spacer 56*a* which is rigidly, flushly fixed to the mounting bracket 12 by welding, the spacer being generally flat and extending outwardly from the face 53 a distance exceeding the thickness of the tongue 16. The guidemeans 56 further includes a guide plate 56*b* which is fixed to the spacer 56*a* by any means known to the art, such as welding, and overlies the spacer to cooperate with the spacer 56*a* and the outer face 53 of the mounting bracket to define a track 56*c* along which the tongue 16 is slidably receivable and in which the tongue can be retained when in rest position 60. Similarly, the second guideway 58 includes a substantially identical spacer 58*a* having a thickness exceeding the thickness of the tongue 16 and having fixed to the spacer a guide plate 58*b* which overlies the spacer 58*a* so as to define a track 58*c* along which the tongue is slidably receivable.

Each of the spacers 56*a* and 58*a* have a spacer support surface 56*d* and 58*d*, respectively, against which the lateral sides 26 and 28 of the tongue 16 will bear when the tongue is in rest position 60.

Figure 8:
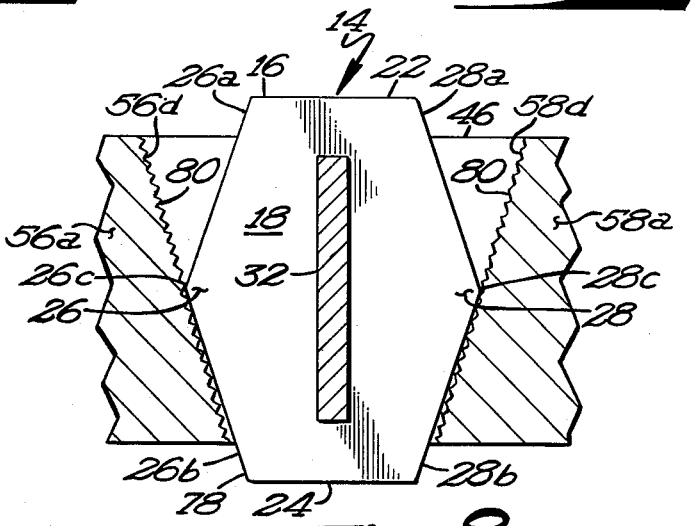
FIG. 8 is a cross sectional front elevation view of the latch apparatus of FIG. 7 taken in the direction of arrows 8—8 and showing in enlarged form the interlocking action of the tongue's camming edges with the roughened spacer surfaces.

Each of the spacer support surfaces 56*d* and 58*d* has a rough texture, as best shown in FIG. 8, so as to confront and interlock with the camming edges 26*c* and 28*c* when the tongue 16 moves into camming position 78 in the guideways, as will be more fully described hereafter. Normally, the roughened texture of the spacer support surface 56*d* and 58*d* will result from cutting of the sheet material.

Accordingly, the spaced-apart converging guideways 56 and 58, which are oriented relative to one another to form a V-like configuration, provide a tongue retaining means by which the tongue 16 may be supported in a rest position 60 within the tracks 56*c* and 58*c*.

In operation, the mounting bracket 12 is attached to the door frame or wall 52 adjacent a door 40. Ordinarily, with the sliding doors associated with machine sheds, the door 40 is slidably movable between a closed position 62, wherein the door fully covers the doorway, and an open position 64, wherein the door is clear of the doorway and spaced several inches away from the doorway, as best shown in FIG. 1. Preferably, the mounting bracket 12 is positioned on the wall or doorway such that it occupies the location between the open and closed positions of the door 40 so that the latch apparatus may be used to retain the door 40 in either open or closed position. The mounting bracket 12 is secured to the wall 52 in the desired position by screws 50 inserted through screw apertures 48 in the bracket 12.

In describing the operation of the latch apparatus 10, it will be presumed that the door 40 is slidably mounted and is initially in the closed position 62. The operator first slidably inserts the tongue 16 of the keeper 14 into the tracks 56c and 58c of the guideways 56 and 58, respectively, with the L-shaped strap 30 being oriented in position 66 to extend toward the door 40, as shown in FIG. 1. The door 40 is slidably moved toward the first segment 32 of the strap 30 in direction 68 until the leading edge 70 of the door 40 contacts the door guiding surface 44 of segment 32. As the door 40 moves toward the segment 32, the leading edge 70 is directed by the surface 44 inwardly toward and along the second segment 34 until the edge 70 contacts the first segment 32. At this stage, the corner 38 of the door 40 is closely confronting and encompassed by the segments 32 and 34 of the strap 30. In this door position 62, the door 40, when subjected to wind forces in the direction 72 (FIG. 7), cannot escape the strap 30 and hence is retained in the upright position 62 without swinging or flapping movement.

When a force 72 acts on the door 40, (FIG. 7) the door corner 38 exerts an outward force 74 on the strap 30, causing the tongue 16 to swing from a rest position 60 within the tracks 56c and 58c to a cammed position 78 wherein the plane of the tongue outer face 18 becomes transverse to the outer face 53 of the mounting bracket with the tongue 16 camming between the spacers 56a and 58a, one of the guide plates, namely 58b and the outer face 53 of the mounting bracket. This camming movement causes the tongue 16 to lock within the guideways 56 and 58 and to thus resist extraction caused by wind or other force 74 applied to the door 40. The described camming is also important in retaining the tongue 16 in the tracks when the latch apparatus is used on gates of fences in which livestock is contained. Not infrequently, livestock will roughly, sharply collide with the fence gate and, without the camming action of the tongue, the applied forces could be adequate to extract the tongue from the mounting bracket.

As the tongue 16 cams in the guideways, the camming edges 26c and 28c tend to tightly engage the roughened surfaces 80 of the spacer support surfaces 56d and 58d as shown in FIG. 8, causing the camming edges 26c and 28c to interlock with the roughened surfaces 80 to further resist extraction of the tongue from the guideways.

Figure 6:
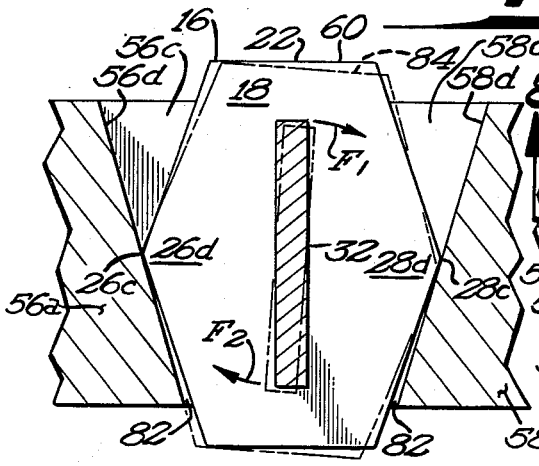
FIG. 6 is a front elevation view partially in phantom of the keeper in rest position and in pivoted dislodging position within the mounting bracket showing the pivoting action of the tongue by which ice and snow may be shattered and dislodged from the mounting bracket.

During winter weather, snow and ice tend to accumulate in the tracks 56c and 58c and, were it not for the shape of the tongue 16, could cause the tongue 16 to become rigidly jammed or frozen in the tracks and difficult to use. This problem has been anticipated and solved by causing the upper and lower sections of the lateral sides 26 and 28 of the tongue 16 to be angled laterally outwardly toward the spacer support surfaces 56d and 58d so that none of the upper and lower sections 26a, 26b, 28a, 28b, are parallel to the spacer support surfaces when the tongue is in rest position 60, resulting in the tongue 18, when in rest position 60, (FIG. 6) having its fulcrums 26d and 28d contacting the spacer support surfaces at camming edges 26c and 28c, respectively. As best shown in FIG. 6, when the camming edges contact the spacer support surfaces, there remains a gap 82 between the lower sections 26b and 28b and the adjacent spacer support surface 56d and 58d, respectively. To remove ice accumulation in the gaps 82, an operator grasps the outwardly extending strap 30 and sharply twists and jerks the strap so as to generate a force couple comprised of forces $F_1$ and $F_2$, causing the tongue 16 to pivot on the camming edge 28c and swing to an ice dislodging position 84. When the force $F_1$ and $F_2$ are applied by the operator, the ice accumulation in gap 82 is sharply compressed and fractured and the tongue 16 immediately freed from the guidemeans 56 and 58.

When it is desired to move the door 40 to an open position 64, the operator lifts the keeper 14 from the guidemeans 56 and 58 and then slides the door 40 to the open position 64. To retain the door in the open position 64, the operator rotates the keeper 14 through a 180 degree arc about the first segment 32 of the keeper, resulting in the strap 30 now being in position 86 (FIGS. 1 and 2) so as to confront and closely retain the door in open position 64. It should be understood that the upper sections 26a and 28a of the track engaging sides 26 and 28 are now positioned downwardly within the guidemeans 56 and 58 but that since the lengths of the upper sections 26a and 28a and their angular orientation are identical to the lower sections 26b and 28b, the function and operation of the keeper is identical to that described earlier and accordingly, the tongue is reversible to have the strap 30 extending leftward in position 86 or rightward in position 66 from the mounting bracket 12.

While the operation has been described in detail, when a sliding door is used with the latch apparatus 10, it should be understood that the sliding door may be replaced by a swinging door or gate and that such swinging door can be as readily retained by the apparatus, which functions substantially identically whether the door is swingably mounted or slidably mounted. While it has been indicated that the invention is particularly well adapted to machine shed doors and farm fences and gates, it should be understood that the invention may be used with other gate or door structures and all such uses as would be apparent to one skilled in the art are within the purview of the invention.

While the preferred embodiment of the present invention has been described, it should be understood that various changes, adaptations and modifications may be made therein without departing from the spirit of the invention and the scope of the appended claims.

What is claimed is:

1. A corner retaining latch apparatus mountable on a door frame for retaining a corner of a door comprising:

a keeper including a tongue and rigid door engaging strap fixed to and extending outwardly from and laterally of said tongue, said strap including door corner retaining means for closely confronting and encompassing a corner of the door to engage the corner and arrest movement of the door toward said strap; and a mounting bracket having an outer face and attachable to the door frame adjacent the door and including tongue retaining means to removably support said tongue in a rest position on said mounting bracket, wherein said door corner retaining means encompasses the corner of the door;

said tongue retaining means including first and second spaced apart, converging guideways fixed to said mounting bracket to slidably receive and support said tongue of said keeper, each said guideway including:

a flat spacer fixed to said outer face of said mounting bracket and extending outwardly from said outer face a distance exceeding the thickness of said tongue; and a guide plate fixed to and overlying said spacer to cooperate with said spacer and said outer face of said mounting bracket to define a track along which said tongue is slidably receivable and in which said tongue is retained when in rest position; and said tongue being flat and movable within said tracks from said rest position to a camming position, wherein the plane of said flat tongue becomes transverse to said outer face of said mounting bracket with said tongue camming between said spacers, a said guide plate and said outer face of said mounting bracket in response to force applied to said strap by said door being forced outwardly, thereby frictionally retaining said tongue in said tracks and resisting dislodgment of said tongue from said guidemeans.

2. The latch apparatus of claim 1 wherein:

said tongue includes a pair of lateral, spaced-apart track engaging sides, each of said track engaging sides having a camming edge oriented transversely to said flat tongue of said bracket and confronting said spacers when said tongue is in said rest position in said guideways; and each said spacer having a support surface confronting one of said camming edges, each said spacer support surface being roughened to permit a said camming edge and said spacer support surface to frictionally interlock and thereby resist sliding movement therebetween when said tongue is moved to said camming position in said guideways.

3. A corner retaining latch apparatus mountable on a door frame for retaining a corner of a door comprising:

a keeper including a tongue and rigid door engaging strap fixed to and extending outwardly from and laterally of said tongue, said strap including door corner retaining means for closely confronting and encompassing a corner of the door to engage the corner and arrest movement of the door toward said strap; and a mounting bracket having an outer face and attachable to the door frame adjacent the door and including tongue retaining means to removably support said tongue in a rest position on said mounting bracket, wherein said door corner retaining means encompasses the corner of the door;

said tongue retaining means including first and second spaced apart, converging guideways fixed to said mounting bracket to slidably receive and support said tongue of said keeper;

said tongue has a pair of spaced apart, track engaging sides, each said track engaging side having a laterally outwardly protruding fulcrum confronting a said guideway when said tongue is in rest position; and each said guideway including a spacer fixed to said outer face of said bracket and having a support surface confronting a said fulcrum of said tongue, said track engaging sides of said tongue and said support surfaces being transverse to one another to permit pivoting of said tongue in said guideways and about a said fulcrum as said fulcrum bears against a said support surface so that accumulations of ice within said guideways may be shattered and forced from between said tongue and said bracket by sharp pivoting of said tongue about a said fulcrum when an operator grips and jerks said strap so as to pivot said tongue.

4. A corner retaining latch apparatus mountable on a door frame for retaining a corner of a door comprising:

a keeper including a tongue and rigid door engaging strap fixed to and extending outwardly from and laterally of said tongue, said strap including door corner retaining means for closely confronting and encompassing a corner of the door to engage the corner and arrest movement of the door toward said strap; and a mounting bracket having an outer face and attachable to the door frame adjacent the door and including tongue retaining means to removably support said tongue in a rest position on said mounting bracket, wherein said door corner retaining means encompasses the corner of the door;

said tongue retaining means including first and second spaced apart, converging guideways fixed to said mounting bracket to slidably receive and support said tongue of said keeper; and said tongue being a generally flat or hexagonal plate having a pair of lateral, spaced apart sides for engaging said guideways and each said lateral side having upper and lower converging adjoining sections of substantially equal length so said tongue may be inserted within said guideways with either said upper sections or said lower sections being inserted within said guideways, permitting said strap to extend at either a lefthand or righthand lateral direction from said bracket, respectively, so as to retain a door located to the left or right, respectively of said latch apparatus.

* * * * *